US012509257B2

(12) United States Patent
Renzini et al.

(10) Patent No.: US 12,509,257 B2
(45) Date of Patent: Dec. 30, 2025

(54) WRAPPING MACHINE

(71) Applicant: AETNA GROUP S.P.A., Verucchio (IT)

(72) Inventors: Andrea Renzini, Verucchio (IT); Alessio Acciarini, Verucchio (IT); Gabriele Canini, Verucchio (IT)

(73) Assignee: AETNA GROUP S.P.A., Verucchio (IT)

( * ) Notice: Subject to any disclaimer, the term of this patent is extended or adjusted under 35 U.S.C. 154(b) by 0 days.

(21) Appl. No.: 18/848,244

(22) PCT Filed: Mar. 16, 2023

(86) PCT No.: PCT/IB2023/052586
§ 371 (c)(1),
(2) Date: Sep. 18, 2024

(87) PCT Pub. No.: WO2023/175558
PCT Pub. Date: Sep. 21, 2023

(65) Prior Publication Data

US 2025/0206477 A1 Jun. 26, 2025

(30) Foreign Application Priority Data

Mar. 18, 2022 (IT) ..... 102022000005381

(51) Int. Cl.
*B65B 11/02* (2006.01)

(52) U.S. Cl.
CPC ..... *B65B 11/025* (2013.01); *B65B 2210/18* (2013.01)

(58) Field of Classification Search
None
See application file for complete search history.

(56) References Cited

U.S. PATENT DOCUMENTS

| | | | | |
|---|---|---|---|---|
| 5,787,691 | A * | 8/1998 | Turfan | B65B 11/025 53/556 |
| 5,850,726 | A * | 12/1998 | Degrasse | B65B 59/001 53/210 |
| 10,011,383 | B2 | 7/2018 | Suolahti et al. | |
| 2014/0250831 | A1* | 9/2014 | Suolahti | B65B 11/025 29/401.1 |
| 2020/0299016 | A1* | 9/2020 | Lancaster, III | B65B 11/025 |

OTHER PUBLICATIONS

International Search Report issued Jul. 26, 2023 in corresponding International Application No. PCT/IB2023/052586.

* cited by examiner

*Primary Examiner* — Chinyere J Rushing-Tucker
(74) *Attorney, Agent, or Firm* — Wenderoth, Lind & Ponack, L.L.P.

(57) ABSTRACT

A wrapping machine for wrapping a load with a film or band comprises a main frame which slidably supports a supporting carriage movable along a working direction, a moving ring rotatably supported by said supporting carriage and rotatable about a wrapping axis which supports an unwinding unit provided with a reel of film and pre-stretching rollers, a sliding electric contact assembly for supplying electric current to, and/or exchanging electric signals with, said unwinding unit and comprising a brush assembly fixed to the moving ring and arranged to slidably abut a conductive bar assembly fixed to a supporting ring connected to the supporting carriage to receive electric current and/or to exchange electric signals; the supporting ring is removably connected to the supporting carriage and interchangeable.

18 Claims, 6 Drawing Sheets

Fig. 5
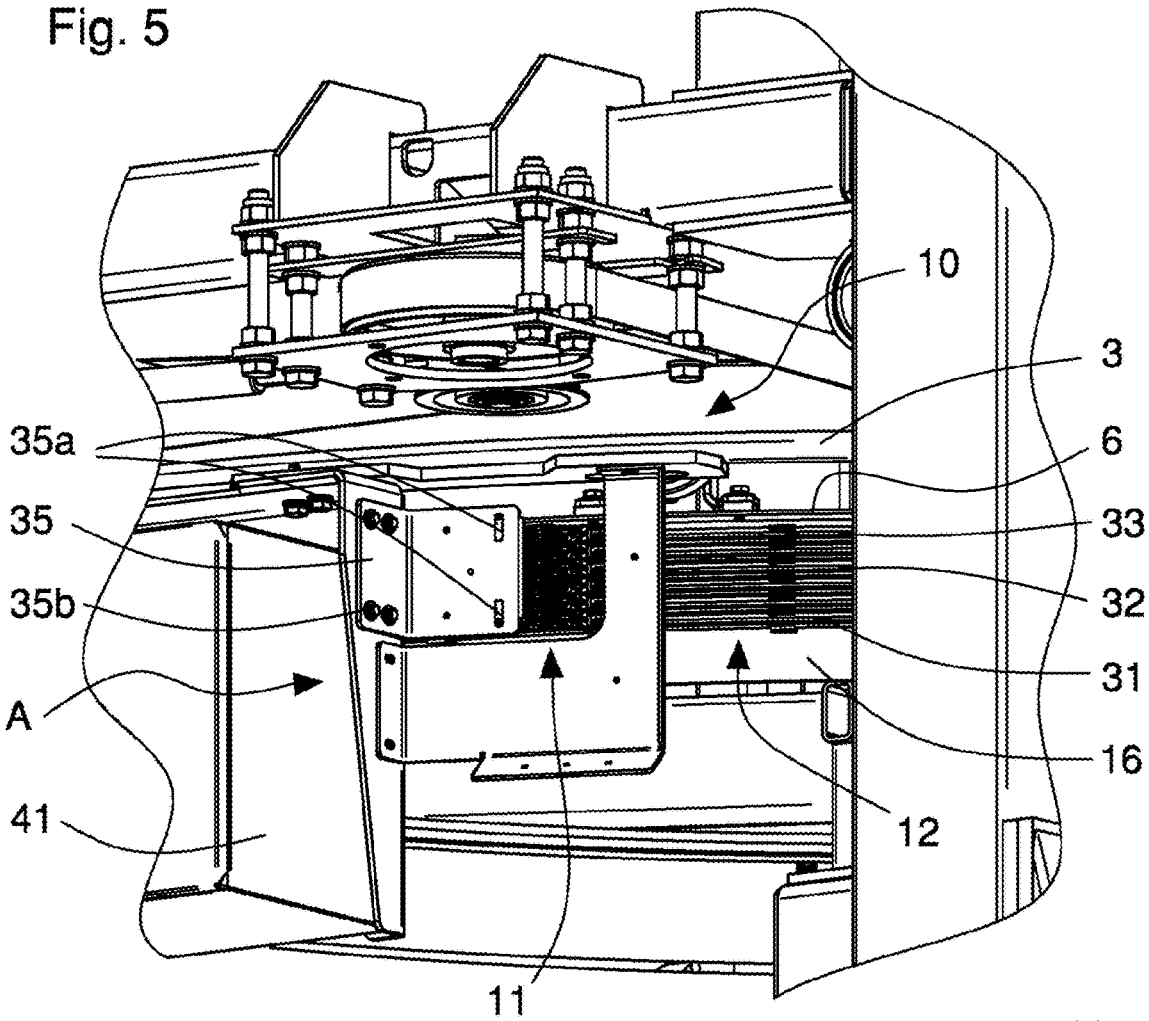
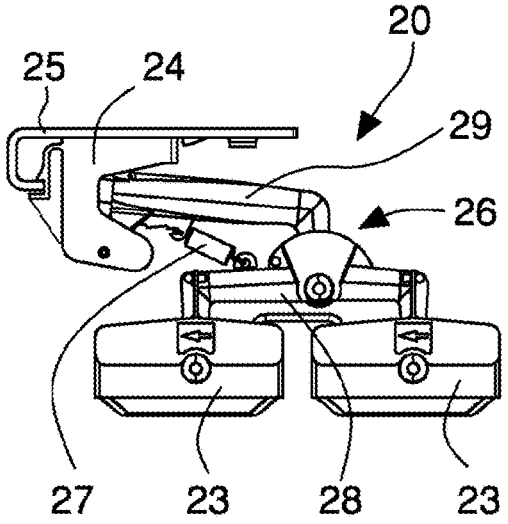
Fig. 6
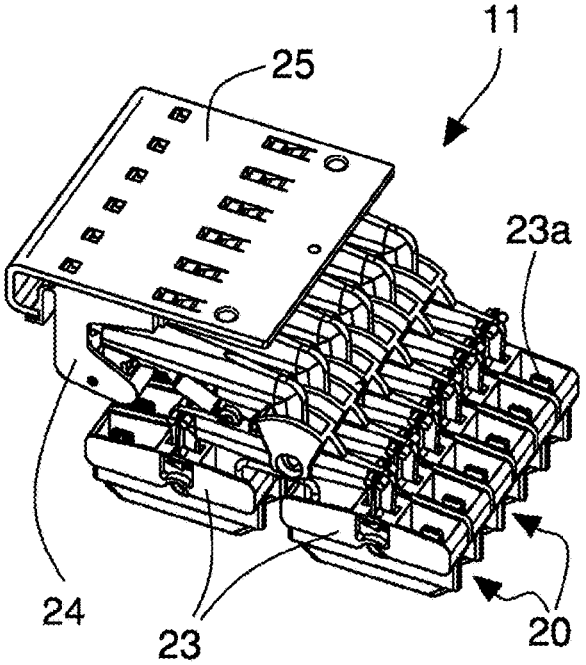
Fig. 7

WRAPPING MACHINE

The invention relates to machines for wrapping a load with a film or band of plastic and/or paper material and, in particular, it relates to a wrapping machine of the horizontal rotating ring type.

Known wrapping machines with horizontal rotating ring comprise a main frame to which is slidably connected a secondary frame, or supporting carriage, configured to rotatably support a ring structure, or rotating ring, to which a unit for unwinding or supplying film is fixed.

The rotating ring is rotatable about a vertical wrapping axis, while the supporting carriage is movable linearly and parallel to the wrapping axis. In this way, the film-unwinding unit is movable parallel to and about the wrapping axis while the load to be wrapped remains fixed. The load is typically composed of one or more products grouped and arranged on a pallet.

The film unwound by a reel mounted on the unwinding unit is wrapped about the load in such a way so as to form a series of interlaced stripes or bands having a helical pattern thanks to the combination of the linear and the rotational movements of the unwinding unit.

In the case of plastic film, the unwinding unit is generally provided with a pair of pre-stretching rollers, comprising a slow roller and a fast roller, respectively upstream and downstream with reference to the movement of the film, to stretch and unwind the extensible film, and one or more diverter or return rollers to divert the film towards the load during the unwinding. By appropriately adjusting the difference between the rotational speeds of the two pre-stretching rollers, it is possible to stretch or elongate the film exiting from the unwinding unit by a defined amount before it is wrapped on the load, according to a fixed pre-stretching or elongation percentage.

The unwinding unit generally comprises an electric motor capable of rotating one of the two pre-stretching rollers, which acts as the drive (master) roller (typically the fast roller), and, via a mechanical transmission assembly, the other pre-stretching roller, which acts as the driven (slave) roller, typically the slow roller. Thereby, a fixed transmission ratio is established between the fast roller and the slow roller, depending on the value of pre-stretching or elongation to be obtained on the film.

Unwinding apparatuses are also known that are provided with a pair of electric motors arranged to separately and independently drive the two pre-stretching rollers, so as to allow the elongation of the film to be varied, i.e. the percentage of pre-stretching or elongation during the wrapping of the load.

Sensors are also mounted on the unwinding unit to detect operating parameters of the wrapping machine and in some cases means for the transmission of control signals via radio (wireless).

In order to electrically power the electric motor or motors driving the pre-stretching rollers and the sensors mounted on the unwinding unit and/or to exchange control signals between the unwinding unit and a control unit of the wrapping machine, in some ring wrapping machines sliding electric contact means are provided, which comprise an annular structure fixed to the supporting carriage and provided on an inner side wall thereof with a plurality of conductive annular bars (sliding contacts) on which respective contacting brushes slide, which are instead mounted on the rotating ring and are electrically connected to the electric motors and sensors of the unwinding unit. The conductive bars are connected by electrical cables to an electrical board for supplying power to and controlling the wrapping machine. The conductive bars are made of metallic material with high electrical conductivity, typically copper, and are bent (calendered) about the inner side wall of the annular structure and fixed to it. The brushes include sliding elements made of material with high electrical conductivity and low friction coefficient, generally graphite-based sintered material.

The brushes are kept in abutment with the conductive bars with a predefined pushing force by means of elastic elements, such as springs, in order to prevent detachments from the conductive bars during operation caused by vibrations, irregularities in the shape of the annular tracks, presence of dirt and debris.

Although the brushes are made of material with a low friction coefficient, they are still subject to progressive wear and should be frequently checked and possibly replaced in order to avoid interruptions in the supply of power current and/or control signals.

In particular, in the case of sensors and/or signal transmission means (wireless transmission boards) any discontinuities or interruptions, even of fractions of a second, of the supply of electric current at low voltage direct may cause malfunctions of the wrapping machine.

In order to avoid such malfunctions during the use of the wrapping machine it is therefore necessary to accurately program the periodic maintenance interventions of the sliding electric contact means, in particular of the brushes.

In known wrapping machines the wear of the brushes is also accentuated by the centrifugal force that acts on the brushes during the rotation of the rotating ring and that contributes with the springs to keep the brushes in contact with the annular conductive bars. However, at high rotational speeds of the rotating ring the centrifugal force (that is proportional to the square of the angular speed) can have high values and lead to rapid wear and tear of the brushes.

In the known wrapping machine, the brushes are accessible with difficulty by the operators for control and replacement operations since the brushes are positioned inside the rotating ring so as to abut the annular tracks fixed to the inner side wall of the annular support structure. These maintenance operations are therefore laborious and time-consuming.

Although subject to less wear, also the annular conductive bars must be periodically checked and possibly replaced.

However replacing the annular conductive bars in the known wrapping machines is a rather complex and difficult procedure since the conductive bars are provided in straight segments that before the assembly must be cut according to the required length and then must be bent (calendered) into an annular/arcuate shape. The annular conductive bars thus obtained must then be fixed to the inner side wall of the annular support structure. The entire replacement procedure, in addition to requiring more specialized operators, causes a long shutdown time of the wrapping machine and therefore of production.

It is an object of the invention to improve known wrapping machines with horizontal rotating ring and provided with sliding electric contact means for transmitting electric current and/or control/command signals to the film unwinding unit.

Another object is to provide a wrapping machine that allows considerable reduction in the wear and tear to which the contacting brushes and the annular conductive bars of the sliding electric contact means are subjected, so as to increase the length of the maintenance intervals for their replacement.

A further object is to provide a wrapping machine that allows a quick and easy replacement of the contacting brushes and the annular conductive bars allowing a considerable reduction in the downtime of the wrapping machine.

A still further object is to achieve a wrapping machine that allows any malfunctions of the sliding electric contact means to be detected, in particular in order to schedule maintenance and/or replacement works of the contacting brushes and the annular conductive bars.

These and other objects are achieved by a wrapping machine according to one or more of the claims set forth below.

The invention can be better understood and implemented with reference to the attached drawings that illustrate an exemplifying and non-limiting embodiment thereof, in which:

FIG. 5 is an enlarged partial perspective view of the wrapping machine of the invention illustrating the sliding electric contact means, and moving and supporting rings;

FIG. 6 is a plan view of a contacting brush;

FIG. 7 is a perspective view of a plurality of contacting brushes;

Figure 1:
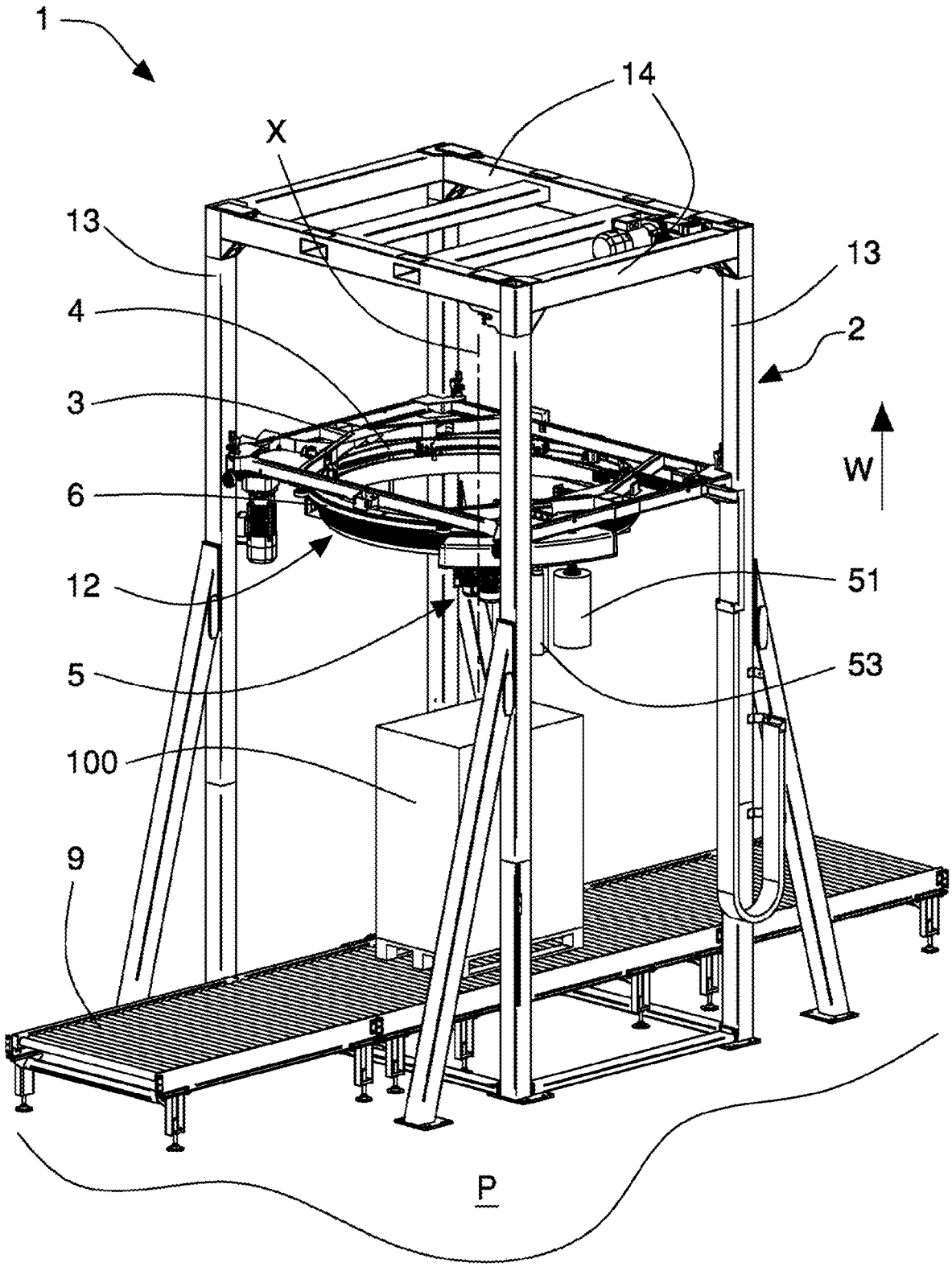
FIG. 1 is a perspective view of the wrapping machine according to the invention.
Figure 2:
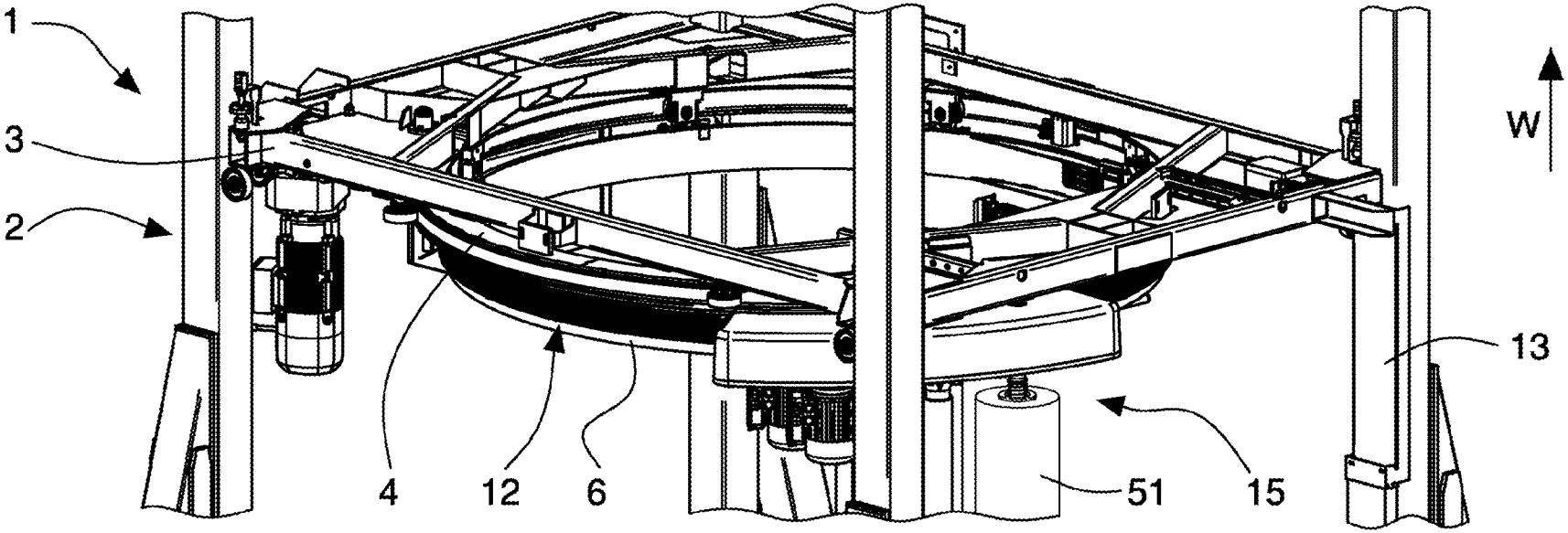
FIG. 2 is an enlarged partial view of the wrapping machine of FIG. 1.
Figure 3:
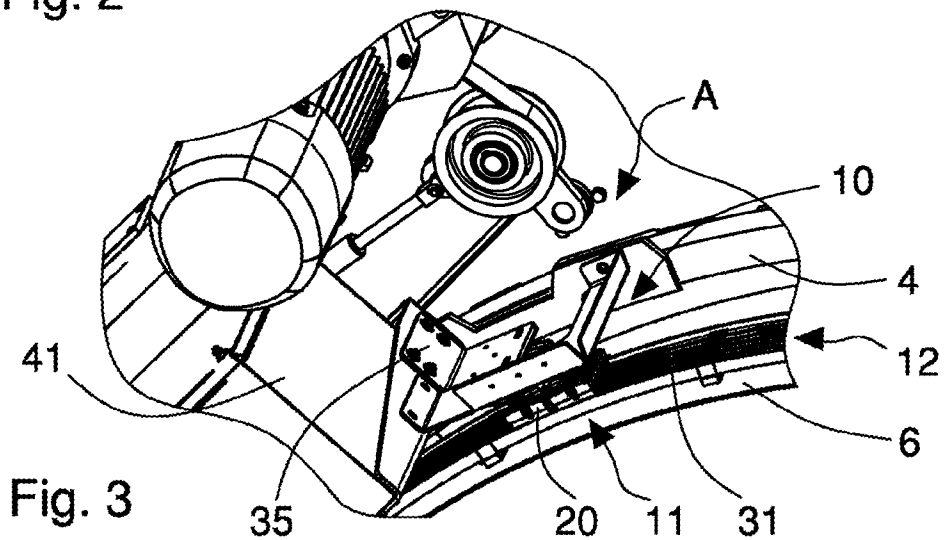
FIG. 3 is an enlarged partial perspective view from below of the wrapping machine of the invention illustrating in particular sliding electric contact means.
Figure 4:
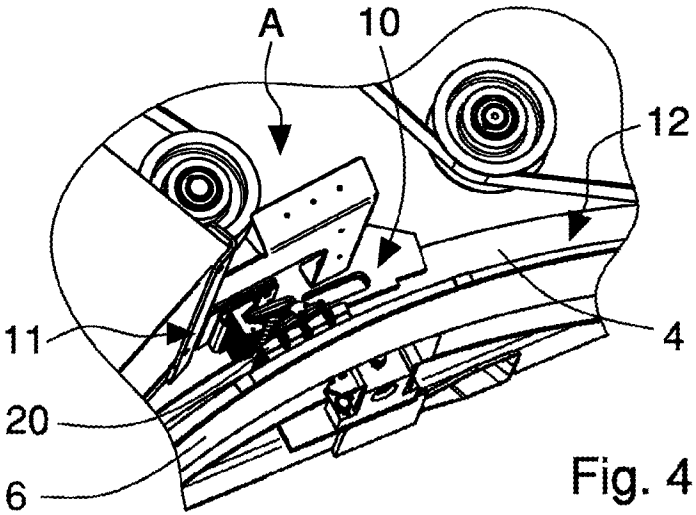
FIG. 4 is another enlarged partial perspective view from below of the wrapping machine of the invention illustrating the sliding electric contact means.

With reference to FIGS. 1 to 5, a wrapping machine 1 according to the invention arranged to wrap a load 100 with a film or band 50 of plastic and/or paper material, for example a plastic film of the cold-extendable type, is schematically illustrated.

The wrapping machine 1 comprises a main frame 2, for example provided with a plurality of supporting columns 13, for example four, interconnected by beam means 14 and a supporting carriage 3 slidably supported by the main frame 2 and moved along a working direction W, in particular substantially vertical.

The wrapping machine 1 also includes a moving ring 4 rotatably supported by the supporting carriage 3 and rotatable about a wrapping axis X parallel to the working direction W, and an unwinding unit 5 fixed to the moving ring 4 and provided with a film reel 51 and pre-stretching rollers 52, 53 for unwinding and pre-stretching the film.

The moving ring 4 is therefore arranged horizontally, parallel to a supporting plane P on which the wrapping machine 1 rests.

The unwinding unit 5 comprises in particular a pair of pre-stretching rollers 52, 53, which unwind the film 50 from the reel 51 and stretch or lengthen it, and one or more return rollers 54, which divert the film 50 towards the product or group of products forming the load 100 to be wrapped. The unwinding unit 5 further comprises at least one electric motor 37, 38 for driving the pre-stretching rollers 52, 53 and sensor means 39 for detecting operating parameters of the unwinding unit 5.

The load 100 is supported and moved in and out of the wrapping machine by conveyor means 9 of known type.

Sliding electric contact means 10 are provided for transferring electric current to, and/or exchanging electrical signals with, the unwinding unit 5.

The sliding electric contact means 10 comprise, in particular, brush means 11 fixed to the moving ring 4 and conductive bar means 12 fixed to a supporting ring 6 that is connected to the supporting carriage 3, in particular coaxially to the moving ring 4. In an operating configuration A, the brush means 11 slidably abut the conductive bar means 12 for supplying electric current and/or for exchanging electric signals with the unwinding unit 5. The supporting ring 6 is for example made of metal sheet and comprises an outer side wall 16, cylindrical shaped and parallel to the wrapping axis X. The outer side wall 16 faces in particular outwards and the supporting columns 13.

The supporting ring 6 is removably connected to the supporting carriage 3, in particular is interchangeable with another identical supporting ring 6 provided with conductive bar means 12, for example new.

The conductive bar means 12 comprise a plurality of annular conductive bars 31, 32, 33, in particular made of copper, fixed, parallel and adjacent to each other, to the outer side wall 16 of the supporting ring 6, and the brush means 11 comprise a plurality of contacting brushes 20, each of which is configured to slidably abut a respective annular conductive bar 31, 32, 33 in the operating configuration A.

Each annular conductive bar 31, 32, 33 has a circular shape in plan.

The supporting ring 6 comprises hooking means 7 arranged to removably and reversibly engage connecting means 8 of the supporting carriage 3 in an assembly configuration M in which the supporting ring 6 is coupled to and supported by the supporting carriage 3, as better explained in the following disclosure.

In particular, the hooking means comprise a plurality of hooking elements 7 configured to removably engage respective connecting elements 8 of the connecting means of the supporting carriage 3 in the assembly configuration M.

The hooking elements 7, for example in number of three, are fixed to an inner side wall 17 of the supporting ring 6, regularly spaced apart.

Figure 9:
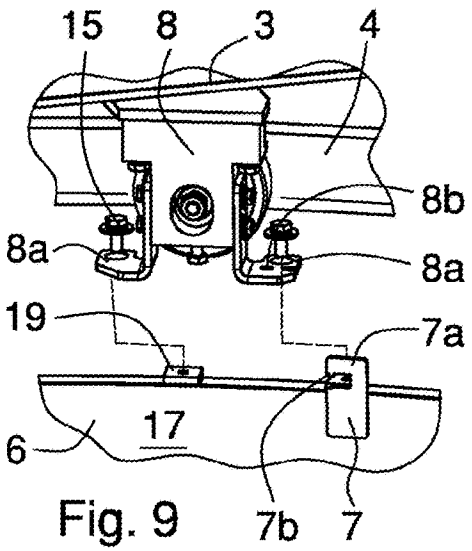
FIG. 9 is an enlarged detail of FIG. 8 which illustrates in particular a hooking element of the supporting ring and a connecting element of the supporting carriage which are disengaged and spaced apart.
Figure 11:
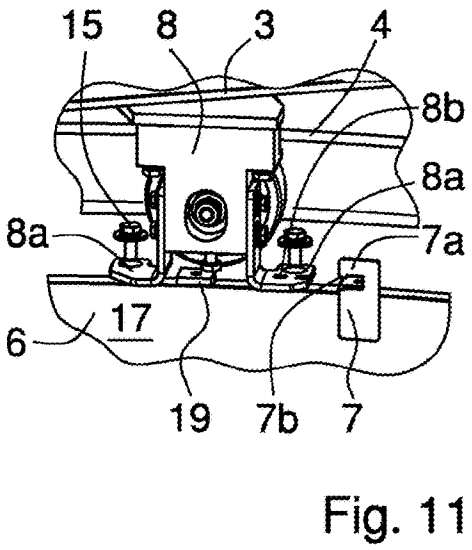
FIG. 11 is an enlarged detail of FIG. 10 illustrating the hooking element and the connecting element.
Figure 13:
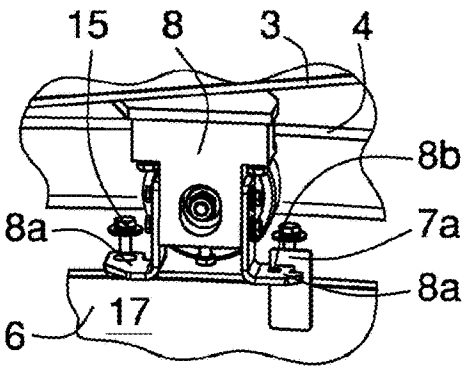
FIG. 13 is an enlarged detail of FIG. 10 which illustrates the hooking element and the connecting element.
Figure 15:
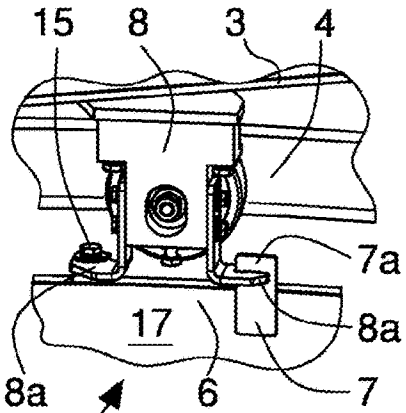
FIG. 15 is an enlarged detail of FIG. 10 which illustrates the hooking element and the connecting element.

With particular reference to FIGS. 9, 11, 13, 15, each hooking element 7 comprises an abutment portion **7*a* adapted to abut a support portion 8*a*, for example substantially horizontal, of a respective connecting element 8 and provided with a shaped end 7***b* adapted to engage a through slot 8*b* made in the support portion 8*a*, at least in the assembly configuration M.

In more detail, each hooking element 7 has a rectangular flat shape and comprises a lower part 7*c* fixed, for example welded, to the inner side wall 17 of the supporting ring 6, and a hook-shaped upper part comprising the abutment portion 7*a* with the shaped end 7*b*.

The supporting carriage 3 comprises a plurality of connecting elements 8, for example in a number equal to that of the hooking elements 7, each of which is provided with a pair of angular brackets having respective support portions 8*a* with slots 8*b*.

Fixing means 15, 19 are provided for reversibly fixing the supporting ring 6 to the plurality of connecting elements 8 in the assembly configuration M.

The fixing means 15, 19 comprise, for example, screws 15 adapted to join the connecting elements 8 to the supporting ring 6. More precisely, each connecting element 8 is fixed to the supporting ring 6 by means of a pair of screws 15 that are inserted in respective holes made on the support portions 8*a* of the connecting element 8 and engage nuts 19 fixed, in particular welded, to an upper edge of the supporting ring 6.

In the embodiment of the wrapping machine 1 of the invention illustrated in the figures, the unwinding unit 5 comprises a pair of electric motors 38, 39 adapted to move the two pre-stretching rollers 52, 53 separately. The sensor means 39 include, for example, a sensor adapted to detect a wrapping force of the film, encoder sensors for measuring the rotational speeds of the electric motors 38, 39, a sensor for detecting the end of the film on the reel, etc.

The electric motors 37, 38 and/or the sensor means 39 are electrically connected to the brush means 11. The conductive bar means 12 are electrically connected to power supply means, configured to supply electric current, and/or to a central control unit 60 of the wrapping machine 1.

In the illustrated and described embodiment of the wrapping machine 1, the brush means 11 are arranged to receive from the conductive bar means 12 only electric current for the unwinding unit 5.

For this purpose, the conductive bar means 12 comprise two first annular conductive bars 31 for transferring a first, in particular direct electric at low voltage current for example at 24V, three second annular conductive bars 32 for transferring a second, in particular alternate three-phase electric current, and a third annular conductive bar 33 for the protective grounding connection.

It is however provided, in an embodiment of the wrapping machine not illustrated, that the brush means 11 and the conductive bar means 12 are adapted to transmit also control and command signals between the unwinding unit 5 and a central control unit 60 of the wrapping machine 1, in particular by means of specific contacting brushes and annular conductive bars.

The wrapping machine 1 of the invention also comprises drive and control means 40 configured to drive and control the electric motors 37, 38 and fixed to the supporting ring 6.

A containment casing 41 is provided for containing the drive and control means 40, fixed to the moving ring 4, for example opposite and facing the unwinding unit 5 in order to act as a counterweight.

The drive and control means 40 comprise, for example, one or more inverters 42 and a local control unit 43, for example a PLC, to drive and control the operation of the electric motors 38, 39. In particular, the drive and control means 40 comprise two inverters 42 connected to the respective two electric motors 37, 38 powered by three-phase alternate electric current through the respective brushes 20 connected to the first annular conductive bars 31 and controlled by the local control unit 43.

The two inverters 52 controlled by the local control unit 43 power the electric motors in a controlled way so as to precisely adjust their rotation speed and/or the power supplied.

The local control unit 43 is powered by the first electric current, i.e. by a direct electric current at low voltage, for example at 24V through respective brushes 20 connected to the second annular conductive bars 32. Similarly, the sensor means 39 mounted on the unwinding unit 5 are powered by the first electric current through the same brushes 20 and are connected to the local control unit 43 to transmit thereto signals relating to measurements and/or detections made.

In the illustrated embodiment of the wrapping machine 1, the drive and control means 40 also comprise a radio or wireless transceiver device 44 which connects the local control unit 43 to a further radio or wireless retransmission device 61 of the central control unit 60 of the wrapping machine 1.

The radio or wireless transceiver device 44, for example positioned within the containment casing 41, is also powered by the first direct electric current.

At least one electric backup battery 45 or buffer battery connected to brush means 11 is provided, to receive from the conductive bar means 12 the first electric current, in particular direct current at low voltage, and connected to the drive and control means 40 to continuously power the drive and control means by the first electric current even in case of interruptions in the transmission of the first electric current due to malfunctions of the sliding electric contact means 10.

In particular, the electric backup battery 45 is interposed between the contacting brushes 20 that abut the first annular conductive bars 31 and the local control unit 43, the sensor means 39, the wireless transceiver device 44. The electric backup battery 45 ensures a continuity of power supply of the direct first electric current in case of interruptions thereof, even of short duration, due to malfunctions of the sliding electric contact means 10, caused by wear and/or dirt of contacting brushes 20 and/or annular conductive bars 31, 32, 33.

The drive and control means 40 also comprise a detector device 46 connected to the brush means 11 so as to receive an electric current from the brush means and configured to detect and record any interruptions in the supply of the said electric current during the operation of the wrapping machine 1.

The central control unit 60 is configured to receive from the detector device 46 data relating to the interruptions in the supply of the electric current, and to determine based on said data maintenance works on the brush means 11 and/or on the conductive bar means 12.

More precisely, the detector device 46 is able to detect and record the frequency and duration of interruptions to the electric current and send related information to the central control unit 60 through the local control unit 43 in order to verify the operation of the wrapping machine 1. In fact, the detector device 46 is connected to the local control unit 43 for transmitting thereto data relating to interruptions in the supply of the electric current. By analysing frequency and duration of interruptions, it is possible to schedule maintenance works for cleaning and/or replacing the contacting brushes 20 and/or the annular conductive bars 31, 32, 33.

In the illustrated embodiment, the detector device 46 receives from the brush means 11 a first electric current, direct current at low voltage, and is therefore connected to the contacting brushes 20 that abut the first annular conductive bars 31, i.e. it is connected in parallel to the electric backup battery 45.

The brush means 11 further comprise a contacting brush 20 which slidably abuts the third annular conductive bar 33 for the protective grounding connection of the means and devices mounted on the unwinding unit 5 and the moving ring 4.

With particular reference to FIGS. 5 to 7, each contacting brush 20 is removably fixed to the moving ring 6, in particular is interchangeable with another identical contacting brush 20, for example in case of excessive wear or malfunction.

Each contacting brush 20 includes at least one conductive sliding block 23 arranged to slidably abut an annular conductive bar and a fixing element 24 reversibly couplable, in particular by an interlocking system with a flexible clip, to bracket means 25 fixed to the moving ring 6. The conductive sliding block 23 is preferably made of graphite or graphite and copper alloy and is provided with a seat 23*a* for coupling to an end connector of an electrical cable.

The contacting brush 20 further comprises supporting means 26 arranged to connect the conductive sliding block 23 to the fixing element 24 and which allow the conductive sliding block 23 adjustment movements, in particular on an adjustment plane orthogonal to the wrapping axis X and to the external side wall 16 of the supporting ring 6.

Each contacting brush 20 comprises elastic means 27 acting on the conductive sliding block 23 to keep it abutting the respective annular conductive bar in the operating configuration A with a defined contacting force.

In the illustrated embodiment, each contacting brush 20 comprises a pair of conductive sliding blocks 23 adjacent and aligned so as to abut the same annular conductive bar, and the supporting means 26 comprise, for example, a supporting element 28 to which the two conductive sliding blocks 23 are fixed and a supporting arm 29 rotatably connected to the fixing element 24 and rotatably supporting the supporting element 28. The elastic means 27, comprising for example one traction helicoidal spring, join the end of the supporting arm 29 connected to the fixing element 24 to the supporting element 28.

The bracket means 25, 35 are adjustably fixed to the moving ring 6 to allow a distance of the brush means 11 from the conductive bar means 12 to be varied along an adjustment direction that is orthogonal to the wrapping axis X.

The bracket means 25, 35 comprise a first bracket 25, angular shaped, to which the fixing elements 24 of the contacting brushes 20 are removably fixable, and a second bracket 35, angular shaped, which supports the first bracket 25 and is adjustably and reversibly fixed to the moving ring 4. The second bracket 35 has a plurality of first through slots 35*a*, for example two, for connection to the first bracket 25 by means of screws. The first slots 35*a* allow adjusting the position of the first bracket 25 along a direction parallel to the wrapping axis X. The second bracket 35 also has a plurality of second through slots 35*b*, for example four, for connection to the moving ring 4 by means of screws. The second slots 35*b* allow adjusting the position of the second bracket 35 along the adjustment direction, in particular orthogonal and radial with respect to the wrapping axis X. In this way, in case of wear of the conductive sliding blocks 23 of the contacting brushes 20 it is possible to quickly and easily modify the position of such conductive sliding blocks with respect to the annular conductive bars 31, 32, 33, more precisely to bring the brushes 20 closer to the annular conductive bars 31, 32, 33, so as to keep them properly in abutment with the predetermined contacting force exerted by the elastic means 27.

During the operation of the wrapping machine 1 of the invention, in the operating configuration A, the contacting brushes 20 of the brush means 11 abut the annular conductive bars 31, 32, 33 of the conductive bar means 12 and ensure the electrical supply of motor means 37, 38, sensor means 39 and drive and control means 40, in particular with a three-phase alternate electric current and a direct electric current at low voltage. Thanks to the elastic means 27 the conductive sliding blocks 23 of the brushes 20 abut the annular conductive bars 31, 32, 33 with a predefined contacting or preloading force so as to guarantee a correct contact and to avoid any detachments caused for example by vibrations or shape errors of the annular conductive bars that could cause malfunction of the unwinding unit 5 and therefore of the wrapping machine.

Since the annular conductive bars 31, 32, 33 are fixed to the outer side wall 16 of the supporting ring 6 the centrifugal force acting on the contacting brushes 20 is not added to the preloading force of the elastic means 27, but is subtracted from the preloading force. In this way, by increasing the rotation speed of moving ring 4 the resulting force acting on the contacting brushes 20 decreases and therefore the frictional force and the wear to which the contacting brushes are subjected decrease. However the preloading force exerted by the elastic means 27 is calculated to ensure that even at the highest rotation speeds of the moving ring 4 the conductive sliding blocks 23 do not detach from the annular conductive bars 31, 32, 33.

This particular configuration of the sliding electric contact means 10 of the wrapping machine 1 of the invention therefore provides longer maintenance intervals than those necessary for the wrapping machines in which the annular conductive bars 31, 32, 33 are mounted on an inner side wall of the supporting ring.

The position outside the supporting ring 6 of the contacting brushes 20 also provides their easy and convenient inspection by an operator and in particular allows adjusting their position with respect to the annular conductive bars 31, 32, 33, along the adjustment direction, for example as a result of wear.

Each contacting brush 20 can also be easily and quickly replaced, even without disassembling the first or second bracket 25, 35 from the moving ring 4, thanks to the fixing element 24 that is reversibly coupled by an interlocking system with flexible clip to the first bracket 25, and thanks to the electric cable that is reversibly coupled by connector to the seat 23*b* of the conductive sliding block 23.

It is also possible to quickly and easily replace the annular conductive bars 31, 32, 33 in case of excessive wear by completely removing the supporting ring 6, to which the annular conductive bars are fixed, from the supporting carriage 3 and replacing it with an identical supporting ring 6 having annular conductive bars 31, 32, 33.

Figure 8:
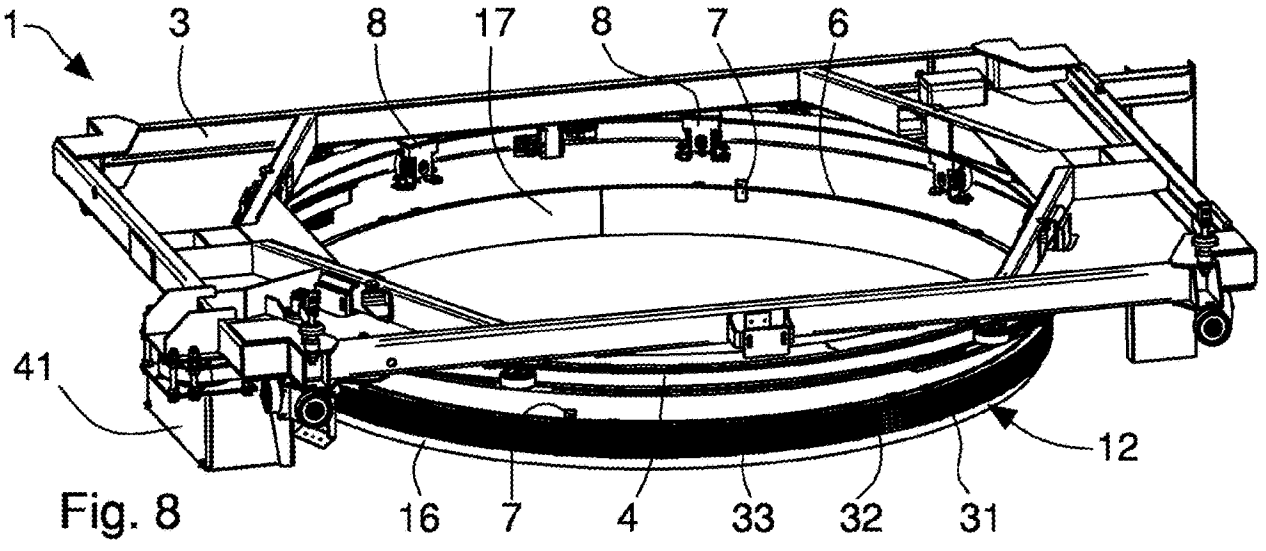
FIG. 8 is a partial perspective view of the wrapping machine of the invention in which a supporting ring of conductive bar means is disassembled from a supporting carriage of the wrapping machine.
Figure 10:
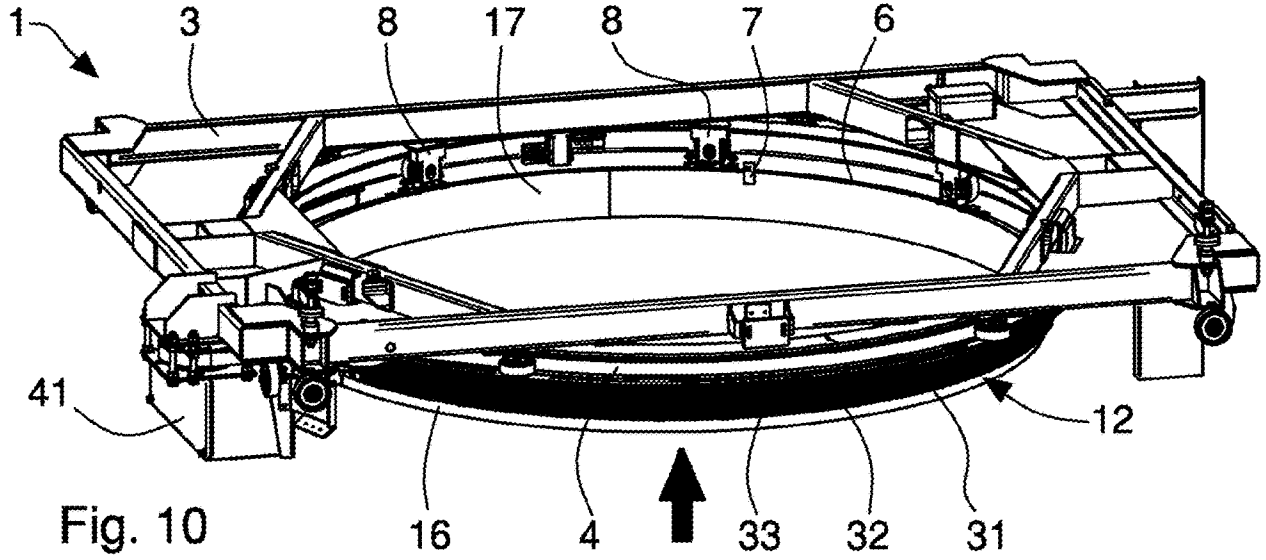
FIG. 10 is a partial perspective view of the wrapping machine of the invention in a first step of the assembly of the supporting ring to the supporting carriage.
Figure 12:
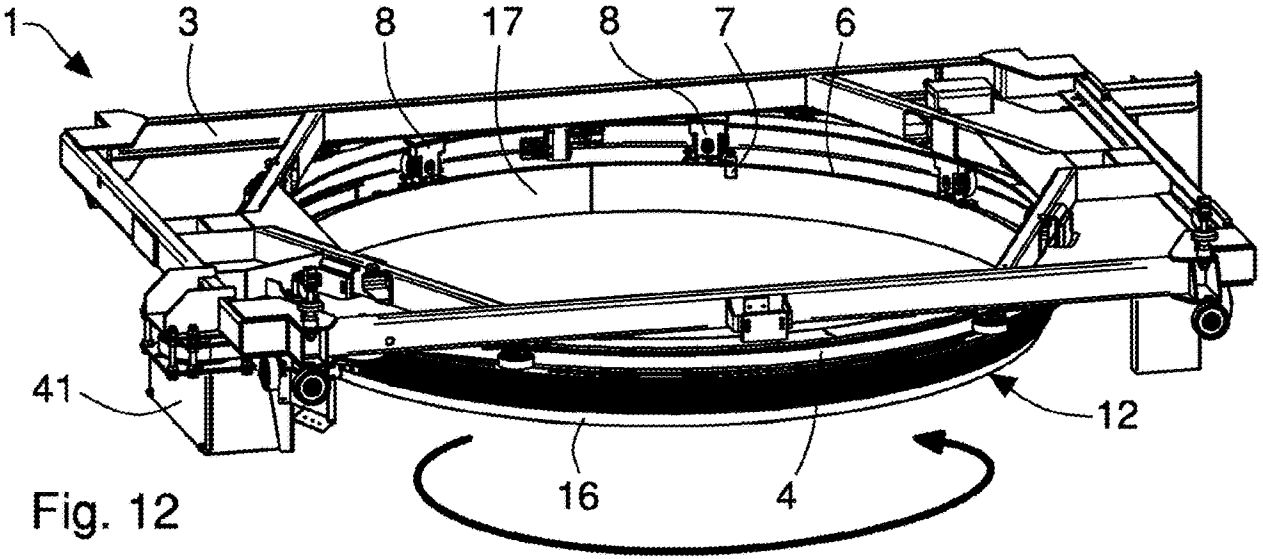
FIG. 12 is a partial perspective view of the wrapping machine of the invention in a second step of the assembly of the supporting ring to the supporting carriage.
Figure 14:
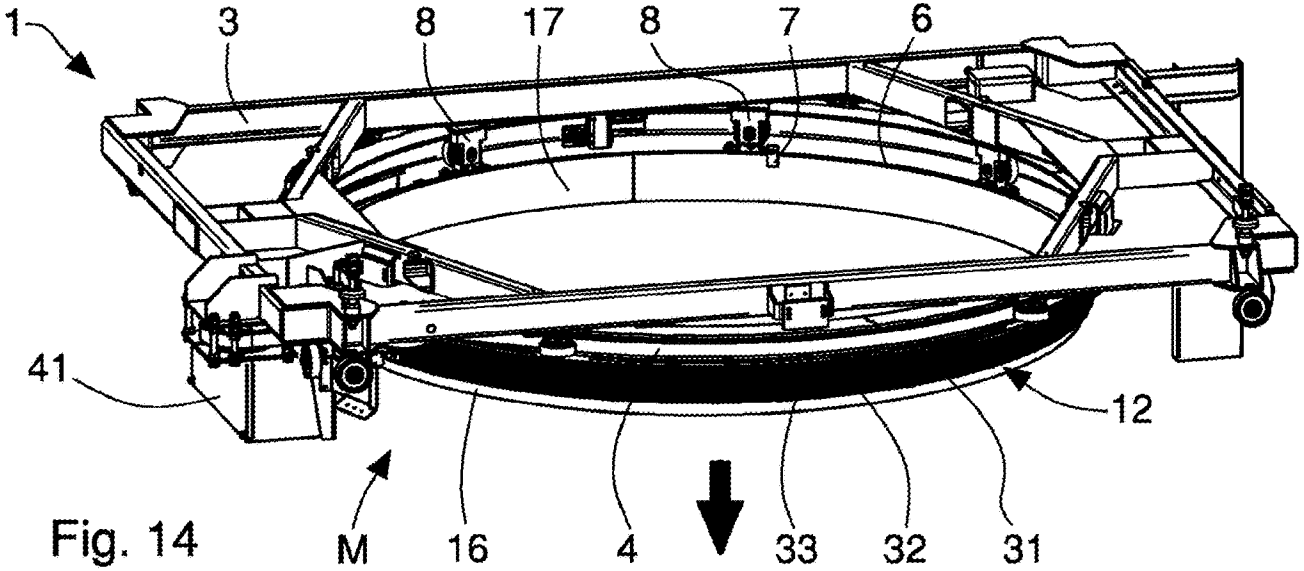
FIG. 14 is a partial perspective view of the wrapping machine of the invention in a third and final step of the assembly of the supporting ring to the supporting carriage.
Figure 16:
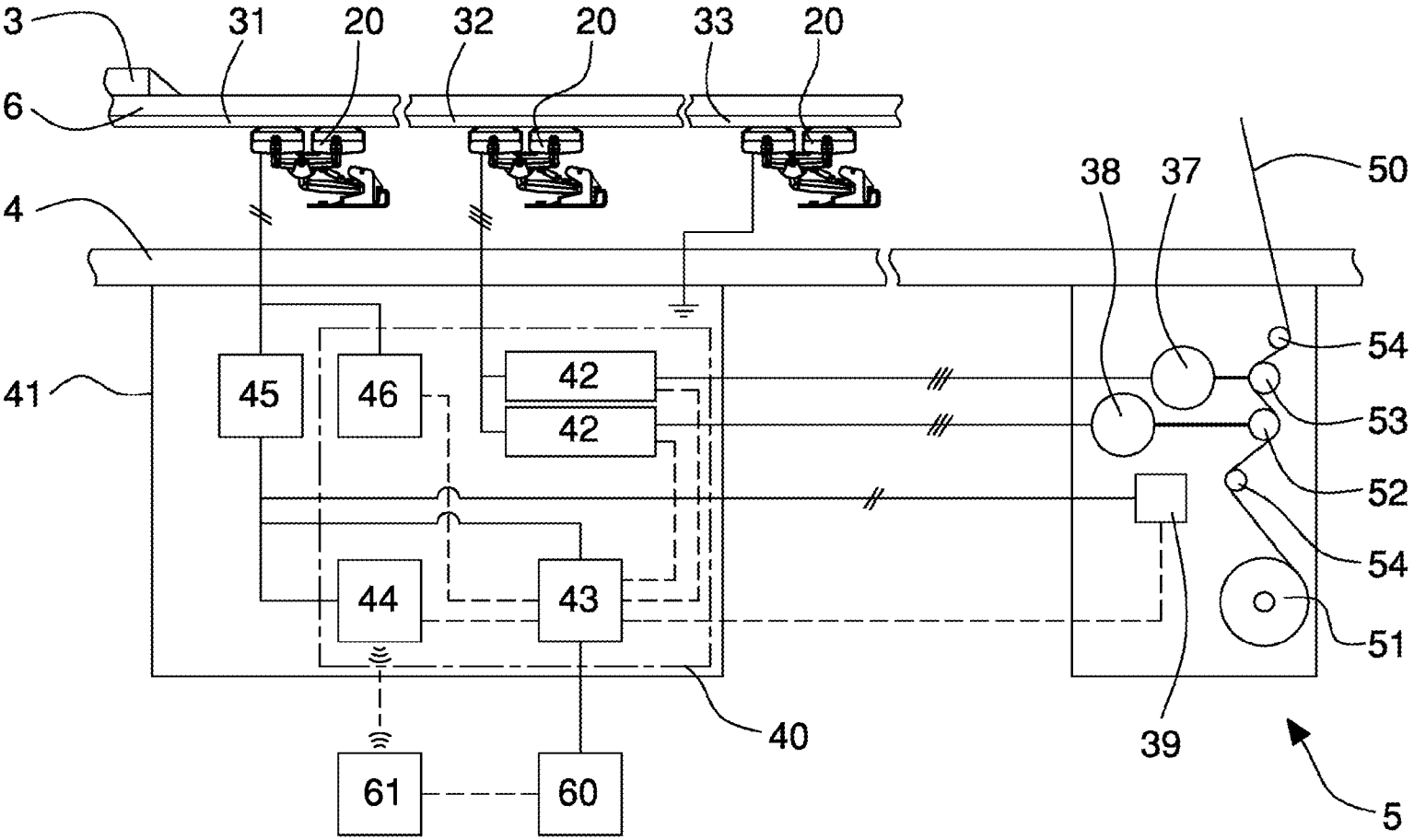
FIG. 16 is a schematic view of the wrapping machine of the invention that illustrates in particular sliding electric contact means, drive and control means and electric motors and sensor means of the unwinding unit.

The replacement procedure is illustrated in FIGS. 8 to 15, which show the various steps of the assembly procedure of a supporting ring 6 with annular conductive bars 31, 32, 33 to the supporting carriage 3.

In a first step (FIGS. 8 and 9) in which the moving carriage 3 of the wrapping machine 1 is lowered to a suitable height, the supporting ring 6 to be assembled is supported below the moving carriage 3 on the conveyor means 9 substantially coaxial to the wrapping axis X and the moving ring 4. The supporting ring 6 is then lifted, in a second step (FIGS. 10 and 11), for example by two operators, in such a way as to bring the abutment portions 7*a* of the hooking elements 7 adjacent to the support portions 8*a* of respective connecting elements 8. In particular, the abutment portions 7*a* are slightly higher than the support portions 8*a* such that in a third step (FIGS. 12 and 13), by slightly rotating the supporting ring 6 about the wrapping axis X, the shaped ends 7*b* of the abutment portions 7*a* are overlapped and aligned with the through slots 8*b* made in the support portions 8*a*. In a fourth step (FIGS. 14 and 15), the support ring 6 is lowered in such a way that the abutment portions 7*a* rest on the support portions 8*a* and the shaped ends 7*b* fit into the through slots 8*b* by stably coupling the supporting ring 6 to the supporting carriage 3 in the assembly configuration M. In this assembly configuration M it is therefore not required to keep the supporting ring 6 lifted, which is already supported and connected to the supporting carriage 3, but it is only necessary to restrain it by means of fixing means 15, 19 to the plurality of connecting elements 8. In particular, only one operator is needed to screw the screws 15 inserted in the holes of the support portions 8*a* of the connecting element 8 to the nuts 19 fixed to the upper edge of the supporting ring 6.

Therefore the wrapping machine 1 of the invention allows not only considerable reducing wear and tear to which the contacting brushes 20 and the annular conductive bars 31, 32, 33 are subjected (so as to increase the length of the maintenance intervals for their replacement), thanks to the assembly of the annular conductive bars on the external side wall 16 of the supporting ring 6, but also allows easily and quickly replacing both the contacting brushes 20 and the annular conductive bars 31, 32, 33, thus providing a considerable reduction in the shutdown times of the wrapping machine 1.

Moreover, thanks to the detector device 46 that is included in drive and control means 40 it is possible during the operation of the wrapping machine 1 to detect and record possible interruptions of the supply of the electric current, in particular of a first direct electric current, due to malfunctions of the sliding electric contact means 10, caused by wear and/or dirt of the contacting brushes 20 and/or of the annular conductive bars 31, 32, 33.

Based on data relating to frequency and duration of such interruptions of the supply of electric current it is possible to schedule maintenance works on brush means 11 and/or conductive bar means 12 for cleaning and/or replacing the contacting brushes 20 and the annular conductive bars 31, 32, 33.

The invention further relates to a method for wrapping a load 100 with a film or band 50 of plastic and/or paper material by means of a wrapping machine 1 comprising a moving ring 4 rotatably supported by a supporting carriage 3, in particular movable along a working direction W on a main frame 2, and rotatable about a wrapping axis X, an unwinding unit 5 fixed to the moving ring 4 and provided with a reel 51 of film 50, sliding electric contact means 10 for supplying an electric current to, and/or exchanging electrical signals with, the unwinding unit 5. The method further comprises:

detecting and recording by means of a detector device 46 connected to the brush means 11 of the sliding electric contact means 10 possible interruptions in the supply of the electric current during the operation of the wrapping machine 1;

transmitting data relating to interruptions of the supply of electric current to a central control unit 60 of the wrapping machine 1;

determining, based on said data, maintenance works for the sliding electric contact means 10.

The method further comprises detecting and recording, by the detector device 46 frequency and duration of interruptions of the electric current. The electric current is in particular a first electric current, in particular a direct current at low voltage, by which drive and control means 40 are powered that are configured to drive and control at least one electric motor 37, 38 for driving pre-stretching rollers 62, 53 of the unwinding unit 5, and sensor means 39 of the unwinding unit 5 adapted to detect operating parameters thereof.

The invention claimed is:

1. A wrapping machine for wrapping a load with a film or band of plastic and/or paper material, the wrapping machine comprising:

a main frame;

a supporting carriage slidably supported by said main frame and movable along a working direction;

a moving ring rotatably supported by said supporting carriage and rotatable about a wrapping axis parallel to the working direction;

an unwinding unit fixed to said moving ring and provided with a reel of film and pre-stretching rollers to unwind and pre-stretch the film;

a sliding electric contact assembly for supplying electric current to, alternatively or additionally exchanging electric signals with, said unwinding unit, said sliding electric contact assembly comprising a brush assembly fixed to said moving ring and a conductive bar assembly fixed to a supporting ring connected to said supporting carriage, and in an operating configuration said brush assembly slidably abutting said conductive bar assembly to receive the electric current alternatively or additionally to exchange the electric signals, wherein said supporting ring is removably connected to said supporting carriage, wherein said conductive bar assembly comprises a plurality of annular conductive bars that are fixed parallel and adjacent to each other to an external side wall of said supporting ring, and wherein said brush assembly comprises a plurality of contacting brushes each of which is configured to slidably abut a respective one of said annular conductive bars.

2. The wrapping machine according to claim 1, wherein said supporting ring comprises a hooking arrangement arranged to engage removably a connecting arrangement of said supporting carriage in an assembly position in which said supporting ring is hooked to and supported by said supporting carriage.

3. The wrapping machine according to claim 2, wherein said hooking arrangement comprises a plurality of hooking elements fixed to said supporting ring and said connecting arrangement comprises a plurality of connecting elements fixed to said supporting carriage, said hooking elements being arranged to engage removably respective connecting elements in the assembly position.

4. The wrapping machine according to claim 3, wherein each hooking element comprises an abutment portion adapted to abut a resting portion of a respective connecting element, said abutment portion being provided with a shaped end capable of engaging a slot of said resting portion in the assembly position.

5. The wrapping machine according to claim 3, further comprising fixing elements for reversibly fastening said supporting ring to said plurality of connecting elements in the operating configuration.

6. The wrapping machine according to claim 5, wherein said fixing elements comprise screws adapted to connect said connecting elements to said supporting ring.

7. The wrapping machine according to claim 1, wherein said unwinding unit comprises at least one electric motor to rotate said pre-stretching rollers and sensors to detect operating parameters of said unwinding unit, said at least one electric motor and said sensors being electrically connected to said brush assembly.

8. The wrapping machine according to claim 7, further comprising a drive and control system fixed to said moving ring and configured at least to drive and control said at least one electric motor of said unwinding unit arranged to rotate said pre-stretching rollers.

9. The wrapping machine according to claim 1, wherein said conductive bar assembly is electrically connected at least to an electrical power supply system.

10. The wrapping machine according to claim 1, wherein said plurality of annular conductive bars of said conductive bar assembly includes two first annular conductive bars for supplying a first electric current, three second annular conductive bars for supplying a second electric current, and a third annular conductive bar for a protective ground connection.

11. The wrapping machine according to claim 1, wherein each contacting brush is removably fixed to said moving ring.

12. The wrapping machine according to claim 11, wherein each contacting brush is interchangeable with another identical contacting brush.

13. The wrapping machine according to claim 8, wherein each contacting brush comprises at least one conductive sliding block arranged to slidably abut a respective annular conductive bar of said conductive bar assembly, and a fastening element which can be reversibly coupled to a bracket assembly fixed to said moving ring.

14. The wrapping machine according to claim 13, wherein each contacting brush further comprises a supporting assembly arranged to connect said at least one conductive sliding block to said fastening element and to allow said at least one conductive sliding block adjustment movements.

15. The wrapping machine according to claim 14, wherein said supporting assembly is arranged to allow said at least one conductive sliding block the adjustment movements on an adjustment plane orthogonal to the wrapping axis.

16. The wrapping machine according to claim 13, wherein each contacting brush further comprises an elastic element acting on said at least one conductive sliding block in order to keep said conductive sliding block abutting said respective annular conductive bar in the operating configuration with a defined contacting force.

17. The wrapping machine according to claim 13, wherein said bracket assembly is fixed in an adjustable way to said moving ring in order to allow varying at least a distance of said brush assembly from said conductive bar assembly along an adjustment direction almost orthogonal to the wrapping axis.

18. The wrapping machine according to claim 1, wherein said supporting ring is interchangeable with another same supporting ring provided with a new conductive bar assembly.

* * * * *